US006754938B2

(12) United States Patent
Savoulidou

(10) Patent No.: US 6,754,938 B2
(45) Date of Patent: Jun. 29, 2004

(54) CLASP FOR JEWELRY ITEMS

(76) Inventor: Galini Savoulidou, Char. Trikoupi & Souliou 29, 181 20 Koridallos-Piraeus Koridallos Attiki (GR)

( * ) Notice: Subject to any disclaimer, the term of this patent is extended or adjusted under 35 U.S.C. 154(b) by 0 days.

(21) Appl. No.: 09/941,393

(22) Filed: Aug. 29, 2001

(65) Prior Publication Data

US 2002/0026695 A1 Mar. 7, 2002

(30) Foreign Application Priority Data

Sep. 6, 2000 (GR) ..... 20000100303

(51) Int. Cl.[7] ..... A44B 11/25

(52) U.S. Cl. ..... 24/616; 24/615; 24/589; 24/68 J

(58) Field of Search ..... 24/265 WS, 265 EC, 24/265 BC, 326, 316, 614–616, 68 J, 69 J, 70 J, 633, 642, 656, 589; 63/12, 3.1, 1.11, 14.4

(56) References Cited

U.S. PATENT DOCUMENTS 1,700,679 A 1/1929 Jones
1,702,360 A 2/1929 Myrberg
2,986,792 A * 6/1961 Wyatt ..... 24/616
3,947,932 A * 4/1976 Flynn ..... 24/616
4,170,809 A * 10/1979 Geldwerth et al. ..... 24/574.1
4,246,680 A 1/1981 Gray
5,231,740 A * 8/1993 Mohebkhosravi ..... 24/574.1
5,272,795 A * 12/1993 Rothstein ..... 24/615
5,379,496 A * 1/1995 Krauss ..... 24/115 G
5,537,725 A * 7/1996 Takahashi ..... 24/615
5,653,009 A * 8/1997 Kassardjian ..... 24/616
6,035,499 A * 3/2000 Ninomiya ..... 24/116 A
6,058,576 A * 5/2000 Harris ..... 24/20 R
6,112,373 A * 9/2000 Steinhauer et al. ..... 24/615
6,309,616 B1 * 10/2001 Ogawa et al. ..... 423/231.2

* cited by examiner

*Primary Examiner*—Robert J. Sandy
*Assistant Examiner*—André L. Jackson

(57) ABSTRACT

A clasp for jewelry items comprising a tongue member and a socket member which are correspondingly connected at the terminal ends of the jewelry item, where the clasp is brought into a locked position when the tongue member is slidably inserted into the socket member and a snapping engagement occurs between engaging elements of the tongue and socket members. The clasp is provided with hook end formations at the free ends of the tongue and socket member, whereby it is connected either directly to axial pin terminal ends of the jewelry item or through extra connecting elements including such axial pin ends thereby ensuring advantageous rotatability of the jewelry terminal ends around the hook end formations of the clasp.

5 Claims, 2 Drawing Sheets

CLASP FOR JEWELRY ITEMS

THE FIELD OF THE ART

This invention relates to a clasp for releasably joining the terminal ends of jewelry items, such as a necklace, bracelet, wristwatch band and the like.

THE BACKGROUND OF THE INVENTION

Amongst the various types of clasps for jewelry items, one category of clasps comprises a compressible tongue member slidably inserted within a generally rectangular socket member, wherein the tongue and rectangular socket member are correspondingly connected to the terminal ends of the jewelry items. U.S. Pat. No. 1,700,679, U.S. Pat. No. 1,702,360, U.S. Pat. No. 4,246,680 or GB 2 132 680 all disclose clasps for jewelry falling under this category.

One major drawback associated with clasps of the above or other category of clasps of the prior art is that they do not provide a universally acceptable mode of connection of the clasp members onto the terminal ends of the jewelry item, as is the case with U.S. Pat. No. 1,700,679 or U.S. Pat. No. 1,702,360 wherein a bracelet item is described comprising a plurality of links flexibly connected together, wherein the tongue and socket member of the clasp are made by means of suitable transformation of the terminal links of this bracelet item. Such type of clasp is however not applicable to any other type of jewelry item. On the other hand, prior art clasps may provide aesthetically and operationally unacceptable mode of connection of the clasp members to the jewelry terminals, such as by means of soldering the clasp members to the jewelry terminals, whereby an unacceptably long rigid portion is formed at the region of the clasp.

A main object of the invention is to overcome this drawback of the prior art and provide a clasp with a hook end at both the tongue and socket member thereof, wherein if the jewelry item includes ends with axial pins, an axial pin end of each one of the terminal ends of the jewelry item is encaged and rotatably connected to the hook ends of the clasp and wherein a further object of the invention is if the jewelry item does not include such an axial pin end to provide an extra connecting element which comprises an axial pin end for rotatably connecting the same to the hook ends of the clasp, whilst the same encages the terminal end of the jewelry item and is soldered therein.

A further object of the invention is to provide a clasp, which with the hook ends of both the socket and tongue member is universally connectable to all types of jewelry items, allowing advantageous rotatability of the jewelry terminal ends around the hook ends of the clasp.

A still further object of the invention is to provide the clasp for jewelry items with alternative arrangements of snapping engagement of either a raised detent onto a resilient part of the clasp tongue into a slot onto the upper surface of the clasp socket or of a slot onto the resilient part of the clasp tongue receiving a stop element of the clasp socket.

A still further object of the invention is to provide the clasp of the invention with a socket member manufactured from a single piece of sheet metal in a single cutting and punching operation, wherein this operation includes forming onto the upper surface of the socket member a pattern which resembles to the pattern of the plurality of links constituting the jewelry item.

A final object of the invention is to provide the clasp with a safety locking means to prevent accidental disengagement thereof, wherein this safety locking means comprises a wire loop rotatable around the tongue member of the clasp to lock into a side knob of the socket member thereof, whilst an end knob is fitted onto the wire loop to facilitate manually gripping and turning of the same into an unlocking position.

With these and other objects in view, the invention will hereinafter be presented in relation to illustrative embodiments.

DESCRIPTION OF PREFERRED EMBODIMENTS

Figure 1:
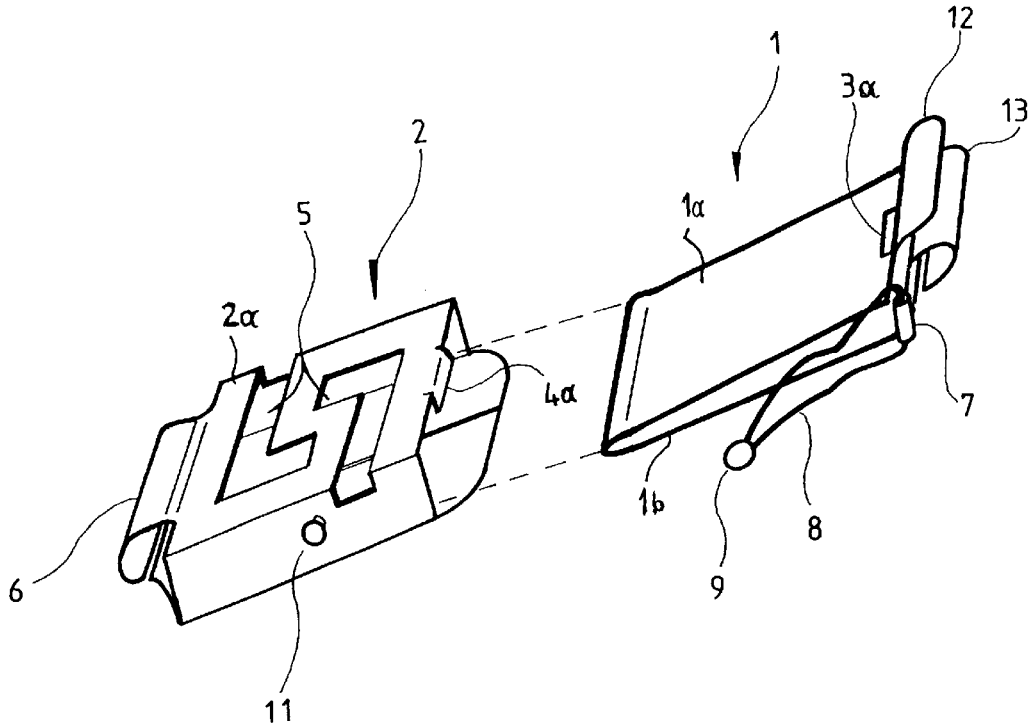
FIG. 1 is a perspective view of the two parts of the clasp, in accordance to one preferred embodiment of the invention, shown in separated position.
Figure 1A:
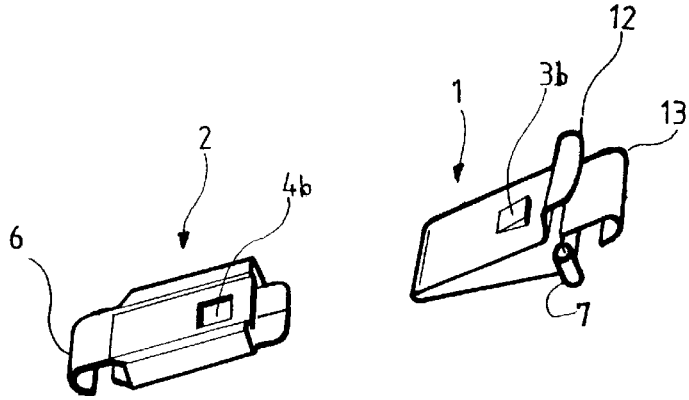
FIG. 1*a* is a perspective view of the two parts of the clasp, in accordance to another preferred embodiment of the invention, shown in separated position.

Referring to the drawings, as shown in FIG. 1 or FIG. 1*a*, the clasp of the invention comprises two parts, a tongue member 1 and a socket member 2.

The tongue member 1 is formed from a single piece of sheet metal, which is folded back on itself to form a resilient part on the upper surface 1*a* thereof extending outwards into an elevated bent portion 12 which constitutes the handle means of the clasp of the invention, whilst the bottom surface 1*b* of tongue member 1 extends outwards into a hook end formation 13.

Figure 2:
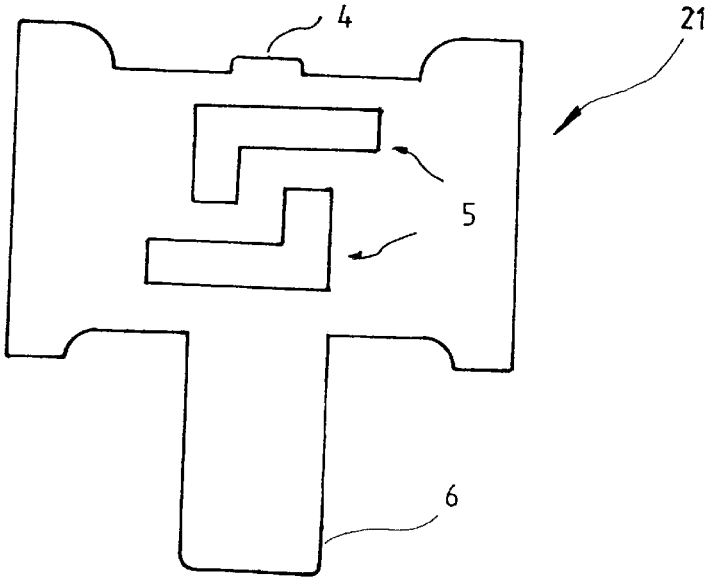
FIG. 2 is a plan view of the sheet metal piece from which the socket member of the clasp of FIG. 1 is formed, shown is spread position.

The socket member 2 of the clasp is a rectangular box suitably dimensioned and with a open end to receive the tongue member 1 of the clasp with an aim of effecting interlocking of the tongue member 1 into the socket member 2 in a manner described in detail herein below. The socket member 2 is formed from a single piece of sheet metal 21, which is shown in spread position in FIG. 2. The piece of sheet metal 21 corresponds to the form of the socket member 2 correspondingly depicted in FIG. 1. The portion of the piece of sheet metal 21 corresponding to the upper surface 2*a* of the socket member 2 is shown extending into an elongated portion 6 which is subsequently wound back on itself to form the hook end formation 6 of the socket member 2.

Figure 3:
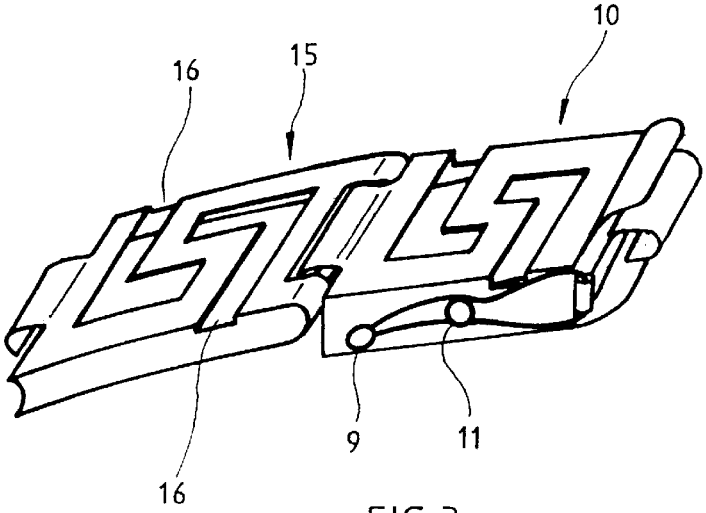
FIG. 3 is a perspective view of the entire clasp in assembled and locked position, connected to one link of a jewelry item.
Figure 4B:
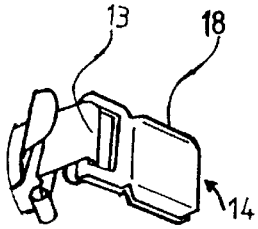
FIG. 4*b* is a detail showing the extra connecting element of FIG. 4 following connection to the tongue member of the clasp.

In accordance with a preferred embodiment of the invention, a pattern 5 is being formed onto the upper surface 2*a* of the socket member 2, so that this pattern 5 may advantageously correspond to the pattern 16 in each one of a plurality of links 15 constituting the jewelry items as illustratively shown in FIG. 3.

The hook end formations 6 end 13 at the free ends of the socket member 2 and tongue member 1 respectively are characteristic features of the clasp of the invention, allowing for its employment in a variety of jewelry items in two alternative modes of connection as follows:

In a first mode of connection wherein the jewelry item comprises an axial pin on each one of the terminal ends thereof, as is the case with the jewelry item comprising a plurality of links 15 of FIG. 3, the clasp 10 of the invention is connected at the terminal ends thereof with the hook end formations 6 and 13 of the clasp 10 correspondingly encaging the axial pins at the terminal ends of the jewelry item and subsequently being closed to effect a freely rotatable connection of the clasp to the jewelry item.

Figure 4A:
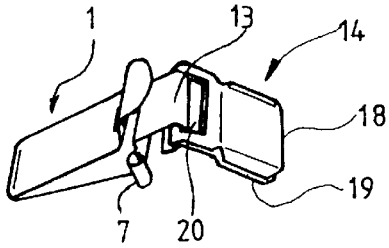
FIG. 4*a* is a perspective view of the extra connecting element of FIG. 4 being brought into a position for connection to the tongue member of the clasp.
Figure 4:
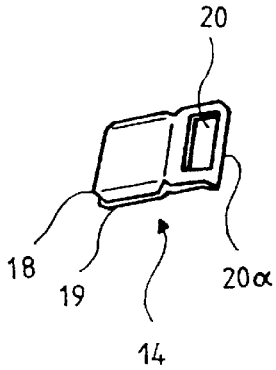
FIG. 4 is a perspective view of an extra connecting element employed in association with the clasp of the invention.

In an alternative mode of connection, wherein the jewelry item does not include such axial pin ends, an extra connecting element is used to effect rotatable connection of the clasp to the terminal ends of the jewelry item. The extra connecting element 14 being shown in FIG. 4 is a single piece of sheet metal being folded back on itself to form a pair of closely spaced parallel surfaces 18 and 19 at one end thereof, in between which is fitted and fixedly soldered the terminal end of the jewelry item and an axial pin 20*a* at the other end thereof, wherein the axial pin 20*a* is connected to the clasp in the same way as mentioned above, i.e. by means of bringing the hook end formations 6 or 13 of the clasp to an encaging position of the axial pins 20*a* at the terminal ends of the jewelry item and subsequently closing the same to effect a freely rotatable connection of the clasp to the jewelry item.

FIG. 1 and FIG. 1*a* present two alternative arrangements for interlocking the tongue member 1 into the socket member 2 of the clasp of the invention, such interlocking being preferably effected by means of a snapping engagement of the tongue member into the socket member of the clasp. To this effect, the upper resilient surface of the tongue member 1 is provided with an engaging element that snaps into an engaging element on the upper surface of the socket member 2, following slidably inserting of the tongue member 1 through the open end of the socket member, thereby bringing the clasp into a locked position. When the user desires to bring the clasp into an unlocked position, he manually depresses the elevated bent portion 12 adapted to be used as the handle means of the clasp to effect disengagement of the engaging elements at the upper surfaces of the tongue member and socket member of the clasp and thereafter freely slidably withdraw the tongue member 1 from the open end of the socket member 2 of the clasp.

More specifically, as shown in FIG. 1, the tongue member 1 of the clasp is provided with a slot 3*a* onto the upper resilient surface 1*a* thereof, which receives a stop element 4*a* of the socket member 2 of the clasp. Alternatively, as shown in FIG. 1*a*, the tongue member 1 of the clasp is provided with a raised detent 3*b* onto the upper resilient surface 1*a* thereof, which snaps into a slot 4*b* of the socket member 2 of the clasp.

In FIG. 1 and FIG. 3 is shown in an unlocked and locked position respectively a safety locking means incorporated in the clasp of the invention, which acts so as to prevent accidental disengagement of the clasp. The safety locking means is a wire loop 8, which is pivotally connected at a tubular member 7 at the side of the tongue member 1 of the clasp that locks into a side knob 11 of the socket member 2 of the clasp. Rotation of the wire loop 8 around the tubular member 7 is facilitated by an end knob 9 that offers handy manually gripping and turning of the same into the unlocked position.

What is claimed is:

1. Clasp for jewelry items comprising a tongue member and a socket member, said tongue member being connected to one terminal end of a jewelry item and said socket member being connected to the other terminal end of the jewelry item, said socket member formed from a single piece of metal into a rectangular box having an open end to receive said tongue member, said tongue member formed from a single piece of metal being folded back on itself to form a resilient part on the upper surface thereof extending outwards into an elevated bent portion that is adapted for being used as the handle means of the clasp, said clasp being brought into a locked position when, following slidably inserting of said tongue member into said socket member, a snapping engagement occurs between an engaging element on the resilient part on the upper surface of said tongue member and an engaging element on the upper surface of said socket member and said clasp being brought into an unlocked position when, following manual pressing downwards of said elevated bent portion at the tongue member of the clasp, disengagement occurs between said engaging element on the upper surface of said tongue member and said engaging element on the upper surface of said socket member and said tongue member is slidably withdrawn from said socket member of the clasp, each one of said tongue member and said socket member of the clasp extending into a hook end formation adapted for rotatable connection to corresponding terminal ends of the jewelry item, wherein when the clasp is connected at a jewelry item with axial pin terminal ends said hook end formations of said tongue member and said socket member of the clasp correspondingly encage the axial pin terminal ends of the jewelry item and are subsequently closed to effect a freely rotatable connection of the clasp to the jewelry item, whilst when the jewelry item does not include axial pins on each one of the terminal ends thereof, said clasp comprising an extra connecting element for each one of the terminal ends of the jewelry item to effect rotatable connection of the clasp to the terminal ends of the jewelry item, said extra connecting element being a single piece of sheet metal being folded back on itself to form a pair of closely spaced parallel surfaces at one end thereof, in between which is fitted and fixedly soldered the terminal end of the jewelry item and an axial pin at the other end thereof, wherein the clasp is connected at the terminal ends of the jewelry item with said hook end formations of said tongue member and said socket member of the clasp correspondingly encaging the axial pins of the extra connecting elements at the terminal ends of the jewelry item and subsequently being closed to effect a freely rotatable connection of the clasp to the jewelry item.

2. Clasp for jewelry items according to claim 1 wherein said engaging element on the upper surface of said tongue member is a slot and said engaging element on the upper surface of said socket member is a stop element, said slot on the upper surface of said tongue member being adapted to effect a snapping engagement with said stop element of said socket member following slidably inserting of said tongue member into said socket member of the clasp.

3. Clasp for jewelry items according to claim 1 wherein said engaging element on the upper surface of said tongue member is a raised detent and said engaging element on the upper surface of said socket member is a slot, said raised detent on the upper surface of said tongue member being adapted to effect a snapping engagement with said slot of said socket member following slidably inserting of said tongue member into said socket member of the clasp.

4. Clasp for jewelry items according to claim 1, further comprising a safety locking means acting so as to prevent accidental disengagement of the clasp, said safety locking means being a wire loop pivotally connected at a tubular member at the side of said tongue member of the clasp and locking into a side knob of said socket member thereof, wherein an end knob is provided at the free end of said wire loop offering handy manually gripping and turning of the same into the unlocked position.

5. Method of connecting the terminal ends of jewelry items to a clasp comprising a tongue member and a socket member, said tongue member being connected to one terminal end of a jewelry item and said socket member being connected to the other terminal end of the jewelry item, each one of said tongue member and said socket member of the clasp extending into a hook end formation adapted for rotatable connection to corresponding terminal ends of the jewelry item, alternatively comprising the steps of:

bringing said hook end formations of said tongue member and said socket member of the clasp in a position of correspondingly encaging axial pin terminal ends of the jewelry item and subsequently dosing said hook end formations to effect a freely rotatable connection of the clasp to the jewelry item, or if the jewelry item does not include axial pin terminal ends, using an extra connecting element for each one of the terminal ends of the jewelry item and encaging an axial pin end of said extra connecting element Into said hook end formations of the tongue and socket portion of the clasp and subsequently being closed to effect a freely rotatable connection of the clasp to the jewelry item, whilst fixedly soldering each one of the terminal ends of the jewelry item within a pair of closely spaced parallel surfaces of said extra connecting elements.

* * * * *